US009573172B2

(12) United States Patent
Fukuoka et al.

(10) Patent No.: US 9,573,172 B2
(45) Date of Patent: Feb. 21, 2017

(54) GAS WIPING METHOD AND GAS WIPING APPARATUS

(71) Applicant: NIPPON STEEL & SUMITOMO METAL CORPORATION, Tokyo (JP)

(72) Inventors: Shinichi Fukuoka, Tokyo (JP); Yoshihiro Suemune, Tokyo (JP); Tooru Oohashi, Tokyo (JP); Yoko Amano, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/373,972

(22) PCT Filed: Sep. 24, 2013

(86) PCT No.: PCT/JP2013/075651
§ 371 (c)(1),
(2) Date: Jul. 23, 2014

(87) PCT Pub. No.: WO2014/050790
PCT Pub. Date: Apr. 3, 2014

(65) Prior Publication Data

US 2014/0360537 A1 Dec. 11, 2014

(30) Foreign Application Priority Data

Sep. 25, 2012 (JP) ..... 2012-211120

(51) Int. Cl.
*B08B 7/04* (2006.01)
*A47L 5/00* (2006.01)
(Continued)

(52) U.S. Cl.
CPC ..... *B08B 5/02* (2013.01); *C23C 2/003* (2013.01); *C23C 2/20* (2013.01)

(58) Field of Classification Search
None
See application file for complete search history.

(56) References Cited

U.S. PATENT DOCUMENTS 6,503,323 B1 * 1/2003 El-Becha ..... C23C 2/20 118/63
6,713,129 B2 * 3/2004 Tanokuchi ..... C23C 2/20 427/348

FOREIGN PATENT DOCUMENTS

CN 101443471 A 5/2009
JP 1-177350 A 7/1989
(Continued)

OTHER PUBLICATIONS

Chinese Office Action and Search Report and English translation thereof, dated May 4, 2015, for Chinese Application No. 201380003393.5 is provided.
(Continued)

*Primary Examiner* — Eric Golightly
*Assistant Examiner* — Arlyn I. Rivera-Cordero
(74) *Attorney, Agent, or Firm* — Birch, Stewart, Kolasch & Birch, LLP

(57) ABSTRACT

A gas wiping apparatus includes a pair of wiping nozzles which are disposed so as to face each other and interpose a coated steel sheet therebetween in a thickness direction of the coated steel sheet, and each of which ejects a wiping gas along a width direction of the coated steel sheet; a gas shield plate that is disposed at a position which separates toward an outside from each end portion of the coated steel sheet so that the gas shield plate is interposed between the pair of wiping nozzles; and a side nozzle that ejects a gas to form a gas flow along each surface of the gas shield plate in a direction reverse to a direction in which the coated steel sheet is pulled upward.

4 Claims, 13 Drawing Sheets

(51) Int. Cl.

| | |
|---|---|
| ***A47L 9/02*** | (2006.01) |
| ***B05C 13/02*** | (2006.01) |
| ***B08B 5/02*** | (2006.01) |
| ***C23C 2/20*** | (2006.01) |
| ***C23C 2/00*** | (2006.01) |

(56) References Cited

FOREIGN PATENT DOCUMENTS

| | | | |
|---|---|---|---|
| JP | 6-256923 | A | 9/1994 |
| JP | 7-331404 | A | 12/1995 |
| JP | 10-306359 | A | 11/1998 |
| JP | 2003-321756 | A | 11/2003 |
| JP | 2003-321757 | A | 11/2003 |
| JP | 2005-60807 | A | 3/2005 |
| JP | 2006-328487 | A | 12/2006 |
| JP | 2007-31805 | A | 2/2007 |
| JP | 2008-95129 | A | 4/2008 |
| JP | 2009-167455 | A | 7/2009 |
| JP | 2011-202287 | A | 10/2011 |

OTHER PUBLICATIONS

PCT/ISA/210—mailed on Dec. 17, 2013, issued in PCT/JP2013/075651 with English Translation.

* cited by examiner

GAS WIPING METHOD AND GAS WIPING APPARATUS

TECHNICAL FIELD OF THE INVENTION

The present invention relates to a gas wiping method and a gas wiping apparatus.

Priority is claimed on Japanese Patent Application No. 2012-211120, filed on Sep. 25, 2012, the contents of which are incorporated herein by reference.

RELATED ART

Typically, a process of forming a coating layer on a surface of a steel sheet by a hot dip coating is as follows. First, the steel sheet is dipped into a coating bath, and then is pulled upward in a vertical direction from the coating bath. For example, as illustrated in FIGS. 7A, 7B and 7C, a gas wiping apparatus 100 is provided above the coating bath.

FIG. 7A is a view (a front view of the gas wiping apparatus 100) when the gas wiping apparatus 100 is seen in a thickness direction (in an X direction in FIG. 7A) of a coated steel sheet W that is pulled upward from the coating bath (not illustrated). FIG. 7B is a view (a plan view of the gas wiping apparatus 100) when the gas wiping apparatus 100 is seen in a direction (in a vertically upward direction: in a Z direction in FIG. 7B) in which the coated steel sheet W is pulled upward. FIG. 7C is a view (a side view of the gas wiping apparatus 100) when the gas wiping apparatus 100 is seen in a width direction (in a Y direction in FIG. 7C) of the coated steel sheet W.

The gas wiping apparatus 100 of the related art includes a pair of wiping nozzles 101 and 102 which are disposed so as to face each other and interpose the coated steel sheet W therebetween in the thickness direction of the coated steel sheet W (that is, a steel sheet onto which coating metal is deposited) that is pulled upward from the coating bath, and each of which ejects a wiping gas Gw along the width direction of the coated steel sheet W.

The wiping nozzle 101 has a slit-shaped wiping gas ejection port 101*a* provided in the Y direction at a tip end thereof. The wiping nozzle 102 has a slit-shaped wiping gas ejection port 102*a* provided in the Y direction at a tip end thereof. In FIGS. 7A and 7C, a dotted chain line NZ indicates center positions (that is, positions at which the wiping gases Gw are ejected in the Z direction) in the Z direction of the wiping gas ejection ports 101*a* and 102*a*.

The pair of wiping nozzles 101 and 102 blows the wiping gas Gw (for example, an inert gas, air or the like) onto both surfaces of the coated steel sheet W along the width direction thereof immediately after the coated steel sheet W is pulled upward. As a result, unsolidified coating metal (hot dip coating metal) is removed from the surfaces of the coated steel sheet W, and the amount of a coating deposit on the surfaces of the coated steel sheet W is adjusted.

As illustrated in FIGS. 7A and 7B, typically, each of the wiping nozzles 101 and 102 has a length in the Y direction longer than the width of the coated steel sheet W. That is, both ends of each of the wiping nozzles 101 and 102 extend to the outsides farther than both end portions of the coated steel sheet W.

Accordingly, as illustrated in FIGS. 8A and 8B, in a region on the outside of each end portion of the coated steel sheet W, the wiping gases Gw ejected from the pair of wiping nozzles 101 and 102 collide with each other.

In a collision region GC (hereinafter, referred to as a gas collision region) of the wiping gas Gw, as illustrated in FIG. 9, collision (occurrence of a negative pressure) and repulsion (occurrence of a positive pressure) of the wiping gases are repeated and thus, gas turbulence (a gas flow, of which a pressure pulsates between a positive pressure and a negative pressure) occurs to accompany the occurrence of the negative pressure.

During the ejection of the wiping gas Gw, the negative pressure resulting from the gas turbulence occurring in the gas collision region GC causes the hot dip coating metal deposited on each end portion of the coated steel sheet W to be pulled to the outside of each end portion of the coated steel sheet W. As a result, as illustrated in FIG. 8A, a liquid membrane LC of the hot dip coating metal is formed on each end portion of the coated steel sheet W to swell toward the outside.

As described above, droplets S (hereinafter, referred to as splashes) spatter from the liquid membrane LC of the hot dip coating metal, which is formed on each end portion of the coated steel sheet W, and are deposited on the wiping nozzles 101 and 102, peripheral equipment or the coated surface of the coated steel sheet W. For convenience of description, FIGS. 8A and 8B illustrate only the outside of one end portion of the coated steel sheet W, but the same phenomenon occurs on the outsides of both end portions of the coated steel sheet W.

When the splashes S are deposited on the wiping nozzles 101 and 102, opening areas of the wiping gas ejection ports 101*a* and 102*a* reduce. When the splashes S are increasingly deposited on the wiping nozzles 101 and 102, the wiping gas ejection ports 101*a* and 102*a* are blocked. When the splashes S are deposited on the peripheral equipment, there is a possibility that the deposition portions of the splashes S corrode. When the splashes S are deposited and solidified on the coated surface of the coated steel sheet W, the dimension or the exterior of the coated surface is adversely affected.

In the related art, there is a case where as illustrated in FIGS. 10A and 10B, a gas shield plate 103 for suppressing the spattering and the deposition of the splashes S is disposed at a position which separates toward the outside from each end portion of the coated steel sheet W. The gas shield plate 103 is disposed so that the gas shield plate 103 is interposed between the wiping nozzle 101 and the wiping nozzle 102. That is, the wiping gases Gw ejected from the pair of wiping nozzles 101 and 102 collide with both surfaces of the gas shield plate 103.

As a result, as illustrated in FIGS. 10A and 10B, the gas collision region GC has reduced width in the Y direction, and the gas turbulence occurring in the gas collision region GC also generates reduced negative pressure, thereby causing the liquid membrane LC of the hot dip coating metal to swell less toward the outside from each end portion of the coated steel sheet W, and decreasing the amount of the splashes S that spatter from the liquid membrane LC.

As such, when the gas shield plate 103 is provided, the spattering and the deposition of the splashes S can be suppressed to some extent. For convenience of description, FIGS. 10A and 10B illustrate only the outside of one end portion of the coated steel sheet W, but the same phenomenon occurs on the outsides of both end portions of the coated steel sheet W.

A distance between each end portion of the coated steel sheet W and the gas shield plate 103 is preferably set to be as short as possible (the gas collision region GC is set to be small) in order for the liquid membrane LC on each end portion of the coated steel sheet W to be less affected by the negative pressure of the gas turbulence occurring in the gas collision region GC.

However, in a real operation, each end portion of the coated steel sheet W pulled upward from the coating bath is not always at a constant position in the Y direction. Accordingly, it is necessary to set the distance between each end portion of the coated steel sheet W and the gas shield plate 103 to a value with a safety margin so that the coated steel sheet W and the gas shield plate 103 do not come into contact with each other. That is, there is a limit to the splash suppression effect by the gas shield plate 103.

As described above, only with the gas shield plate 103 being provided at the position which separates toward the outside from each end portion of the coated steel sheet W, it is difficult to sufficiently suppress the spattering and the deposition of the splashes S.

In particular, in the recent hot dip coating, the amount of coating liquid that is picked up increases in conjunction with a high coating velocity, there is a tendency that a pressure of ejecting the wiping gas is increased in order for the amount of a coating deposit to be reduced and thus, a countermeasure against the splashes becomes an important task. Accordingly, a wiping process of the hot dip coating requires a measure that serves to effectively suppress or prevent the spattering and the deposition of the splashes S.

For example, as illustrated in FIGS. 11A and 11B, Patent Document 1 discloses a technology in which a purge gas ejection nozzle 104 is provided in a gap between each end portion of the coated steel sheet W and the gas shield plate 103, and the purge gas ejection nozzle 104 ejects a purge gas Gp in a direction (in a vertically downward direction) reverse to the direction in which the coated steel sheet W is pulled upward.

According to the technique, a gas curtain resulting from the purge gas Gp is formed in the gap between each end portion of the coated steel sheet W and the gas shield plate 103. As a result, the directions in which the splashes S spatter from each end portion of the coated steel sheet W are limited to the vertically downward direction, and the spattering and the deposition of the splashes S are suppressed.

PRIOR ART DOCUMENT

Patent Document

[Patent Document 1] Japanese Unexamined Patent Application, First Publication No. H07-331404

DISCLOSURE OF THE INVENTION

Problems to be Solved by the Invention

As described above, according to Patent Document 1, the spattering and the deposition of the splashes S can be further suppressed by the provision of the purge gas ejection nozzle 104 compared to when only the gas shield plate 103 is provided. However, according to research performed by the inventor, it is determined that the technique disclosed in Patent Document 1 does not sufficiently cope with a high wiping gas pressure in conjunction with a high-speed hot dip coating process, and there is still room for improvement in the viewpoint of the splash suppression effect.

The present invention is made in consideration of the above-described problems, and an object of the present invention is to provide a gas wiping method and a gas wiping apparatus which have a splash suppression effect greater than that of the related art.

Measures for Solving the Problem

The present invention adopts the following measures to solve the above-described problems and to achieve the related object.

(1) A gas wiping method according to an aspect of the present invention is a method in which a wiping gas is ejected along a width direction of a coated steel sheet from a pair of wiping nozzles which are disposed so as to face each other and interpose the coated steel sheet therebetween in a thickness direction of the coated steel sheet that is pulled upward from a coating bath and thus, the amount of a coating deposit of the coated steel sheet is adjusted. The method includes disposing a gas shield plate at a position which separates toward an outside from each end portion in the width direction of the coated steel sheet so that the gas shield plate is interposed between the pair of wiping nozzles, ejecting a gas from a side nozzle disposed at a predetermined position and thus, forming a gas flow along each surface of the gas shield plate in a direction reverse to a direction in which the coated steel sheet is pulled upward.

(2) In the gas wiping method according to (1), the side nozzle may be disposed on each surface of the gas shield plate.

(3) In the gas wiping method according to (1) or (2), the gas ejected from the side nozzle may be air or an inert gas.

(4) A gas wiping apparatus according to an aspect of the present invention includes a pair of wiping nozzles which are disposed so as to face each other and interpose a coated steel sheet therebetween in a thickness direction of the coated steel sheet that is pulled upward from a coating bath, and each of which ejects a wiping gas along a width direction of the coated steel sheet; a gas shield plate that is disposed at a position which separates toward an outside from each end portion in the width direction of the coated steel sheet so that the gas shield plate is interposed between the pair of wiping nozzles; and a side nozzle that ejects a gas to form a gas flow along each surface of the gas shield plate in a direction reverse to a direction in which the coated steel sheet is pulled upward.

(5) In the gas wiping apparatus according to (4), the side nozzle may be disposed on each surface of the gas shield plate.

(6) In the gas wiping apparatus according to (4) or (5), a gas ejected from the side nozzle may be air or an inert gas.

Effects of the Invention

According to the aspects, it is possible to significantly suppress the spattering and the deposition of the splashes of unsolidified coating metal in a hot dip coating process compared to the related art. That is, according to the aspects, it is possible to provide the gas wiping method and the gas wiping apparatus which have a splash suppression effect greater than that of the related art.

EMBODIMENTS OF THE INVENTION

Hereinafter, an embodiment of the present invention will be described in detail with reference to the accompanying drawings.

Figure 1A:
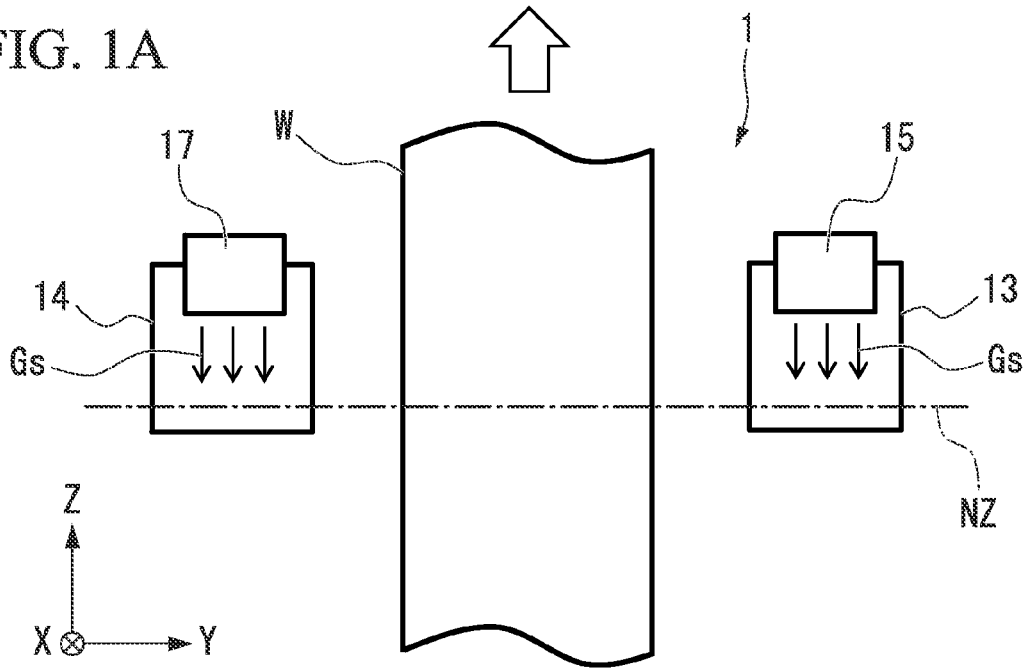
FIG. 1A is a front view of a gas wiping apparatus 1 according to an embodiment of the present invention.
Figure 1B:
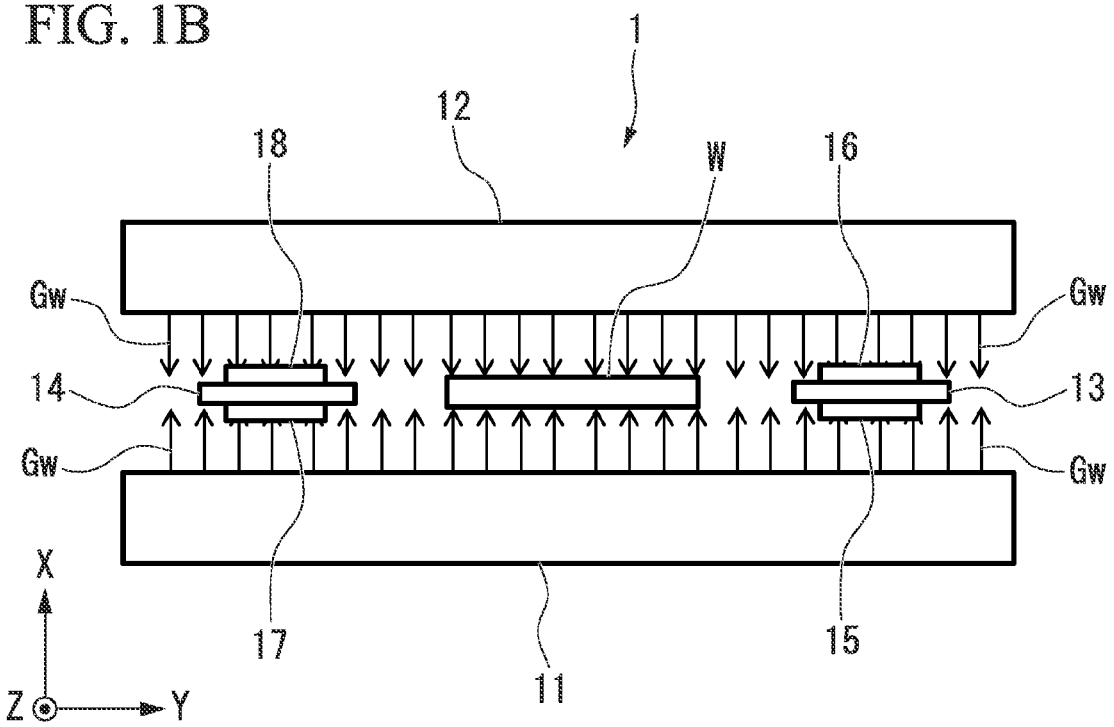
FIG. 1B is a plan view of the gas wiping apparatus 1 according to the embodiment of the present invention.
Figure 1C:
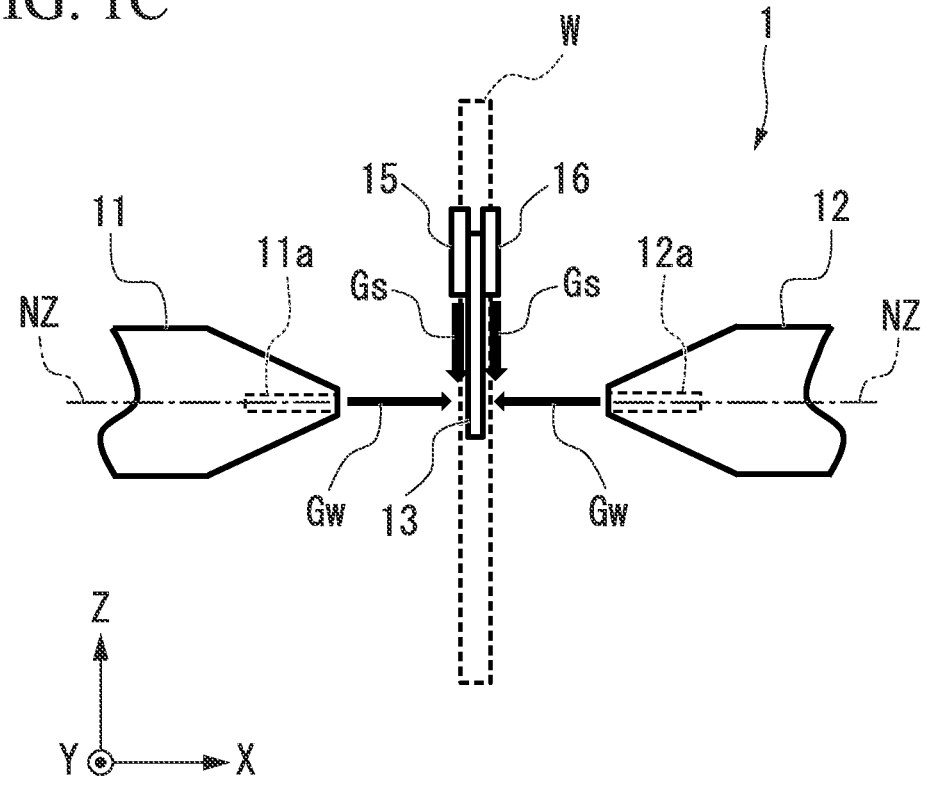
FIG. 1C is a side view of the gas wiping apparatus 1 according to the embodiment of the present invention.

FIGS. 1A, 1B and 1C are schematic views illustrating a configuration of a gas wiping apparatus 1 according to the embodiment. FIG. 1A is a view (a front view of the gas wiping apparatus 1) when the gas wiping apparatus 1 is seen in a thickness direction (in an X direction in FIG. 1A) of a coated steel sheet W that is pulled upward from a coating bath (not illustrated). FIG. 1B is a view (a plan view of the gas wiping apparatus 1) when the gas wiping apparatus 1 is seen in a direction (in a vertically upward direction: in a Z direction in FIG. 1B) in which the coated steel sheet W is pulled upward. FIG. 1C is a view (a side view of the gas wiping apparatus 1) when the gas wiping apparatus 1 is seen in a width direction (in a Y direction in FIG. 1C) of the coated steel sheet W.

As illustrated in FIGS. 1A, 1B and 1C, the gas wiping apparatus 1 according to the embodiment includes a pair of wiping nozzles 11 and 12; two gas shield plates 13 and 14; two first side nozzles 15 and 16; and two second side nozzles 17 and 18. In FIG. 1A, the wiping nozzles 11 and 12 are not illustrated.

The pair of wiping nozzles 11 and 12 are disposed so as to face each other and interpose the coated steel sheet W therebetween in the thickness direction of the coated steel sheet W (that is, a steel sheet on which coating metal is deposited) that is pulled upward from the coating bath, and each of the pair of wiping nozzles 11 and 12 ejects a wiping gas Gw along the width direction of the coated steel sheet W. The wiping nozzle 11 has a slit-shaped wiping gas ejection port 11*a* provided in the Y direction at a tip end thereof. The wiping nozzle 12 has a slit-shaped wiping gas ejection port 12*a* provided in the Y direction at a tip end thereof. In FIGS. 1A and 1C, a dotted chain line NZ indicates center positions (that is, positions at which the wiping gases Gw are ejected in the Z direction) in the Z direction of the wiping gas ejection ports 11*a* and 12*a*.

The gas shield plate 13 is disposed at a position which separates toward the outside from one end portion of the coated steel sheet W in the Y direction so that the gas shield plate 13 is interposed by the wiping nozzles 11 and 12. The gas shield plate 14 is disposed at a position which separates toward the outside from the other end portion of the coated steel sheet W in the Y direction so that the gas shield plate 14 is interposed by the wiping nozzles 11 and 12. The wiping gas Gw ejected from each of the pair of wiping nozzles 11 and 12 collides with each surface of the gas shield plates 13 and 14.

The gas shield plates 13 and 14 are preferably disposed so that the thickness directions of the gas shield plates 13 and 14 coincide with the thickness direction of the coated steel sheet W.

It is preferred that a distance between the gas shield plate 13 and one end portion of the coated steel sheet W be short, but in a real operation, it is necessary to set the distance between the gas shield plate 13 and one end portion of the coated steel sheet W to a value with a safety margin so that the gas shield plate 13 and one end portion of the coated steel sheet W do not come into contact with each other. A distance between the gas shield plate 14 and the other end portion of the coated steel sheet W is also set similarly to the distance between the gas shield plate 13 and one end portion of the coated steel sheet W.

The first side nozzle 15 is disposed in the vicinity of an upper end of a front surface of the gas shield plate 13. The first side nozzle 16 is disposed in the vicinity of an upper end of a rear surface of the gas shield plate 13. The first side nozzles 15 and 16 are disposed so as to face each other and interpose the gas shield plate 13 therebetween.

Each of the first side nozzles 15 and 16 ejects a side gas Gs in a direction (in a vertically downward direction) reverse to the direction in which the coated steel sheet W is pulled upward. Accordingly, a gas flow (hereinafter, referred to as a descending side gas flow) is formed along each surface (front and rear surfaces) of the gas shield plate 13 in a direction reverse to the direction in which the coated steel sheet W is pulled upward.

A slit-shaped side gas ejection port (not illustrated) extending in the Y direction is provided in a tip end of each of the first side nozzles 15 and 16. Accordingly, the side gas Gs is ejected from each of the first side nozzles 15 and 16 and thus, the descending side gas flow having a constant width in the Y direction is formed on each surface of the gas shield plate 13.

The shape of the side gas ejection port provided in the tip end of each of the first side nozzles 15 and 16 is not limited to a slit shape. For example, it is preferred that a plurality of circular side gas ejection ports be provided at constant intervals along the Y direction in the tip end of each of the first side nozzles 15 and 16.

The second side nozzle 17 is disposed in the vicinity of an upper end of a front surface of the gas shield plate 14. The second side nozzle 18 is disposed in the vicinity of an upper end of a rear surface of the gas shield plate 14. The second side nozzles 17 and 18 are disposed so as to face each other and interpose the gas shield plate 14 therebetween.

Each of the second side nozzles 17 and 18 ejects a side gas Gs in a direction reverse to the direction in which the coated steel sheet W is pulled upward. Accordingly, a descending side gas flow is formed along each surface of the gas shield plate 14 in a direction reverse to the direction in which the coated steel sheet W is pulled upward.

A slit-shaped side gas ejection port (not illustrated) extending in the Y direction is provided in a tip end of each of the second side nozzles 17 and 18. Accordingly, the side gas Gs is ejected from each of the second side nozzles 17 and 18 and thus, the descending side gas flow having a constant width in the Y direction is formed on each surface of the gas shield plate 14.

The shape of the side gas ejection port provided in the tip end of each of the second side nozzles 17 and 18 is not limited to a slit shape. For example, it is preferred that a plurality of circular side gas ejection ports be provided at constant intervals along the Y direction in the tip end of each of the second side nozzles 17 and 18. The side gas Gs ejected from each of the first side nozzles 15 and 16 and each of the second side nozzles 17 and 18 is preferably air or an inert gas.

Hereinafter, operational effects of the gas wiping apparatus 1 with this configuration will be described.

Figure 10A:
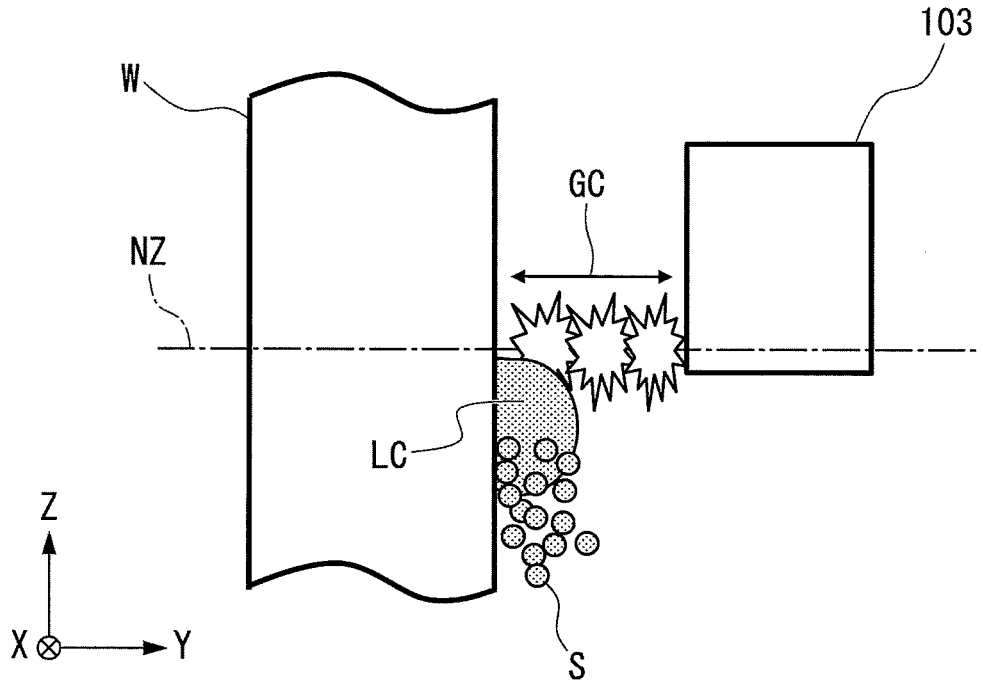
FIG. 10A (PRIOR ART)
FIG. 10A is a schematic view illustrating a mode in which the splashes S spatter from each end portion of the coated steel sheet W when a gas shield plate 103 is provided.
Figure 10B:
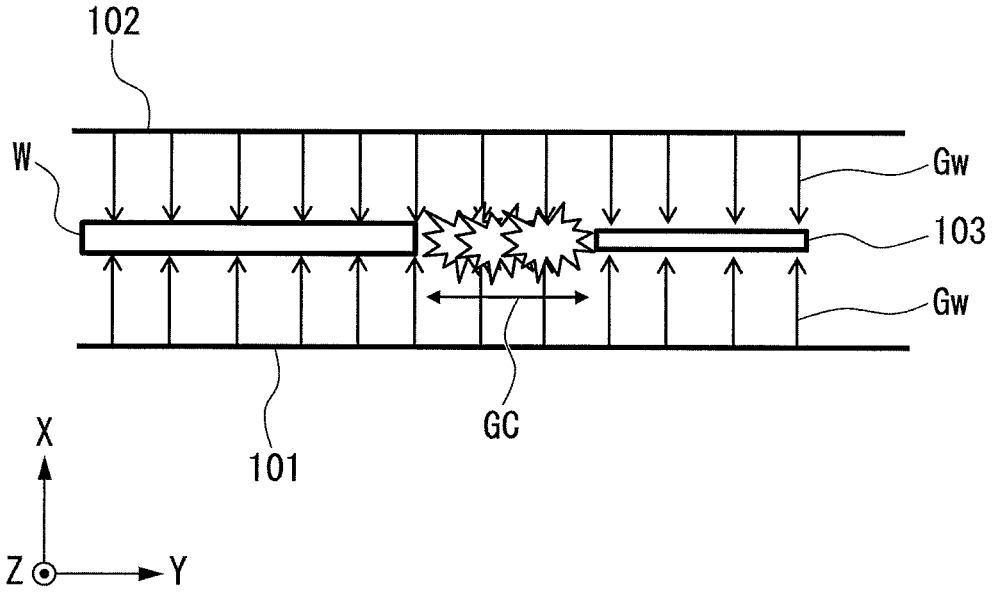
FIG. 10B (PRIOR ART)
FIG. 10B is a schematic view illustrating the mode in which the splashes S spatter from each end portion of the coated steel sheet W when the gas shield plate 103 is provided.

The wiping gases Gw ejected from the pair of wiping nozzles 11 and 12 collide with both surfaces of the gas shield plates 13 and 14. As a result, as illustrated in FIGS. 10A and 10B, the gas collision region GC has reduced width in the Y direction, and gas turbulence occurring in the gas collision region GC also generates reduced negative pressure, thereby causing the liquid membrane LC of hot dip coating metal to swell less toward the outside from each end portion of the coated steel sheet W, and decreasing the amount of the splashes S that spatter from the liquid membrane LC.

The fact that, as such, when the gas shield plates 13 and 14 are provided, the spattering and the deposition of the splashes can be suppressed to some extent was already discussed. However, in a real operation, since it is necessary to set the distance between each end portion of the coated steel sheet W and each of the gas shield plates 13 and 14 to a value with a safety margin so that the coated steel sheet W and the gas shield plates 13 and 14 do not come into contact with each other, there is a limit to a splash reduction effect by the gas shield plates 13 and 14.

Figure 2A:
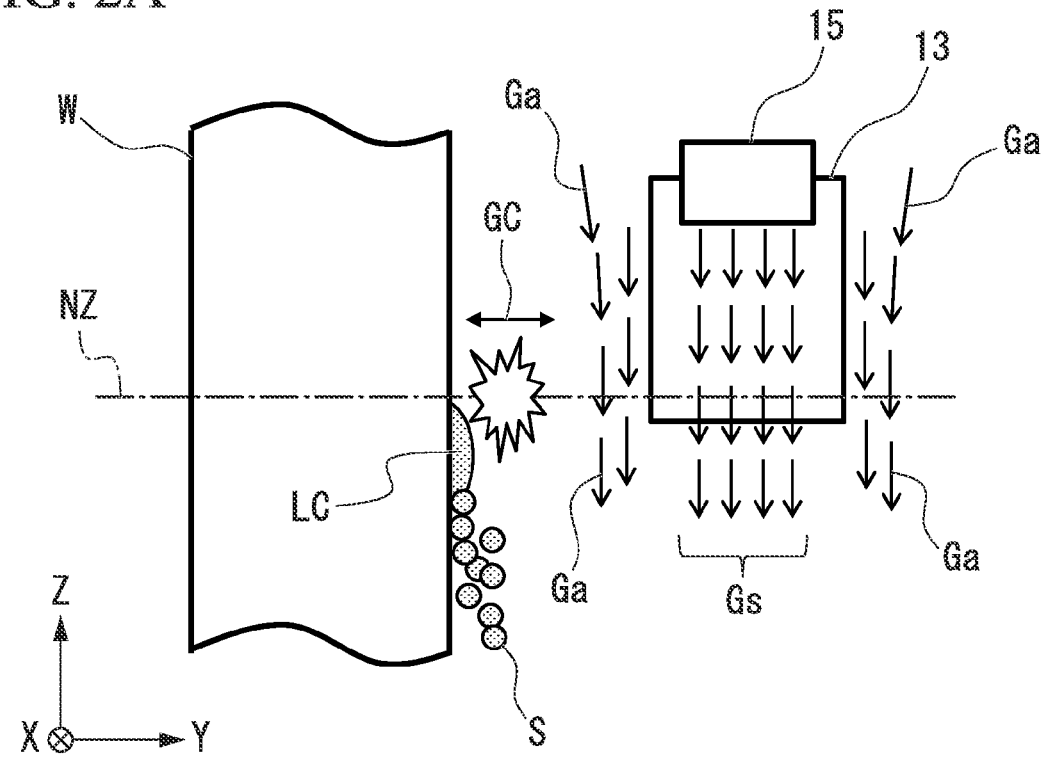
FIG. 2A is a schematic view illustrating a splash suppression effect of the gas wiping apparatus 1 according to the embodiment of the present invention.
Figure 2B:
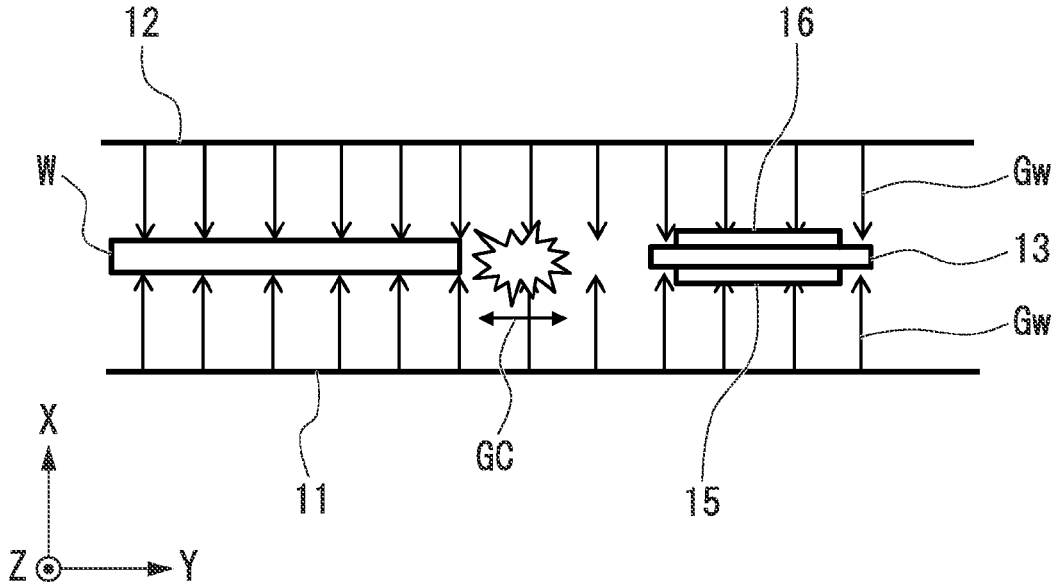
FIG. 2B is a schematic view illustrating the splash suppression effect of the gas wiping apparatus 1 according to the embodiment of the present invention.

In the gas wiping apparatus 1 of the embodiment, the descending side gas flow is formed on each surface of the gas shield plates 13 and 14 by the ejection of the side gas Gs. When the gas shield plate 13 is taken as an example, as illustrated in FIGS. 2A and 2B, a gas flow Ga (hereinafter, referred to as a descending associated gas flow) is formed on the outside of each end portion of the gas shield plate 13 due to the descending side gas flows formed on both surfaces of the gas shield plate 13, and flows in the direction reverse to the direction in which the coated steel sheet W is pulled upward.

As such, part of the gas turbulence occurring in the gas collision region GC stabilizes as a downward gas flow due to the descending associated gas flow Ga formed between the gas shield plate 13 and one end portion of the coated steel sheet W and thus, pressure pulsation is eliminated. This implies that the gas collision region GC between the gas shield plate 13 and one end portion of the coated steel sheet W has reduced width in the Y direction in practicality (the liquid membrane LC on each end portion of the coated steel sheet W is less affected by a negative pressure). The gas shield plate 14 is also subject to the same phenomenon.

That is, according to the embodiment, the liquid membrane LC of the hot dip coating metal can swell less toward the outside from each end portion of the coated steel sheet W (refer to FIG. 2A) than in the related art in which only the gas shield plate is provided. As a result, it is possible to further decrease the amount of the splashes S that spatter from the liquid membrane LC of the hot dip coating metal.

In contrast, as discussed above, the technique (in which the gas shield plate 103 and the purge gas ejection nozzle 104 are combined) disclosed in Patent Document 1 does not sufficiently cope with a high wiping gas pressure in conjunction with a high-speed hot dip coating process, and cannot provide the same level of the splash suppression effect as that of the embodiment. Hereinafter, a reason thereof will be described.

Figure 11A:
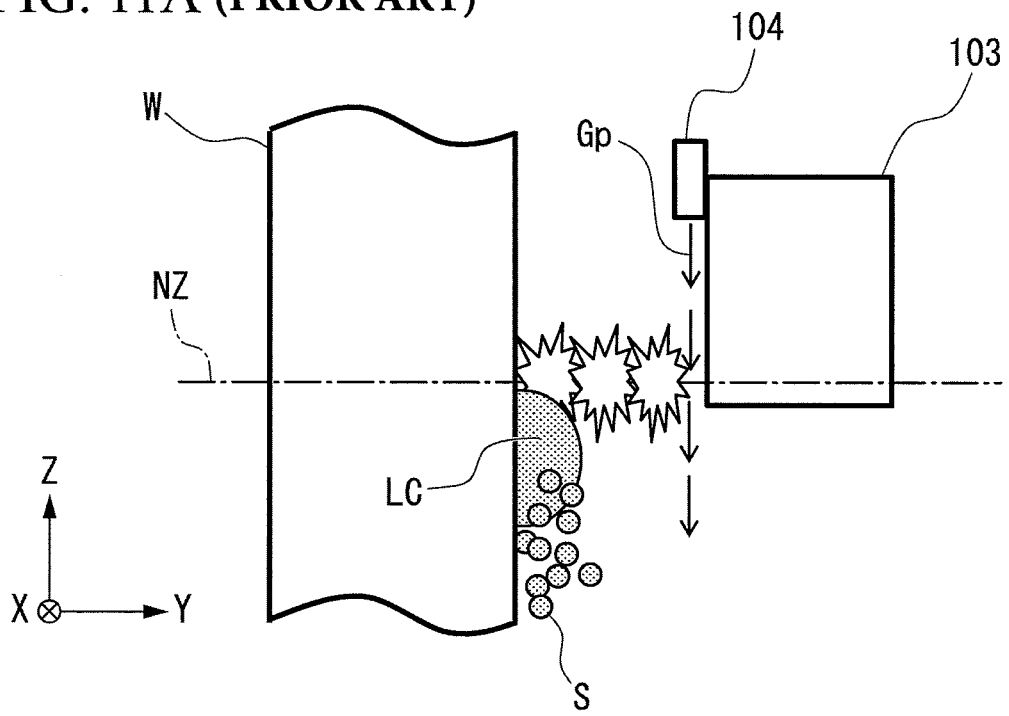
FIG. 11A (PRIOR ART)
FIG. 11A is a schematic view illustrating the technique disclosed in Patent Document 1.
Figure 11B:
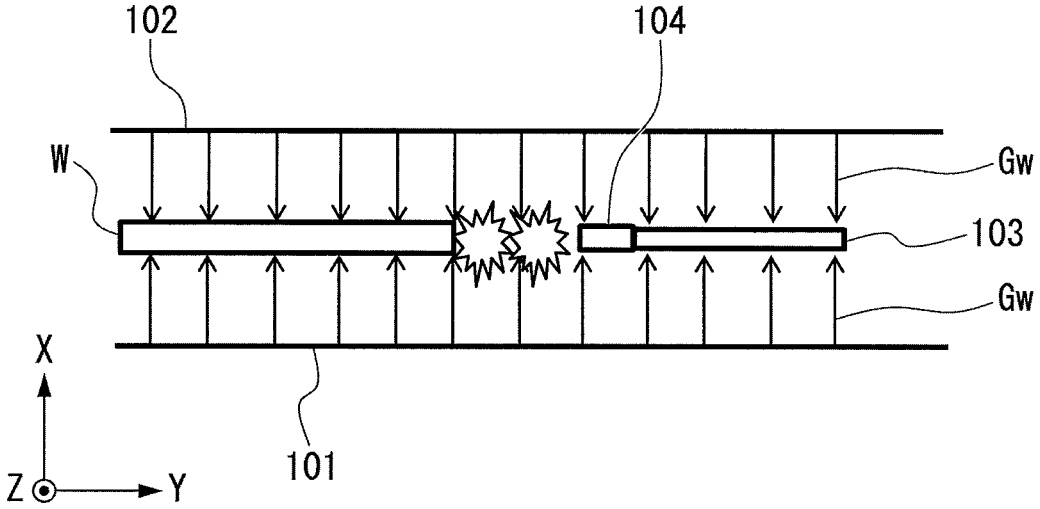
FIG. 11B (PRIOR ART)
FIG. 11B is a schematic view illustrating the technique disclosed in Patent Document 1.

In the technique disclosed in Patent Document 1, the descending flow of the purge gas Gp is formed in the gap between each end portion of the coated steel sheet W and the gas shield plate 103 and thus, the directions in which the splashes S spatter from the liquid membrane LC of the hot dip coating metal which swells toward the outside from each end portion of the coated steel sheet W is limited to the vertically downward direction (refer to FIG. 11A).

Even in the technique disclosed in Patent Document 1, it is considered that since the descending flow of the purge gas Gp is formed in the gap between each end portion of the coated steel sheet W and the gas shield plate 103, part of the gas turbulence occurring in the gas collision region GC stabilizes as a downward gas flow and thus, pressure pulsation is eliminated. That is, even in the technique disclosed in Patent Document 1, it is seemingly considered that similar to in the embodiment, the gas collision region GC between the gas shield plate 103 and each end portion of the coated steel sheet W has reduced width in the Y direction in practicality (the liquid membrane LC on each end portion of the coated steel sheet W is less affected by a negative pressure).

However, according to research performed by the inventor, it is determined that even though the purge gas ejection nozzle 104 ejects the purge gas Gp in the vertically downward direction along the gap between each end portion of the coated steel sheet W and the gas shield plate 103, the width in the Y direction of the gas collision region GC does not become small.

Figure 3A:
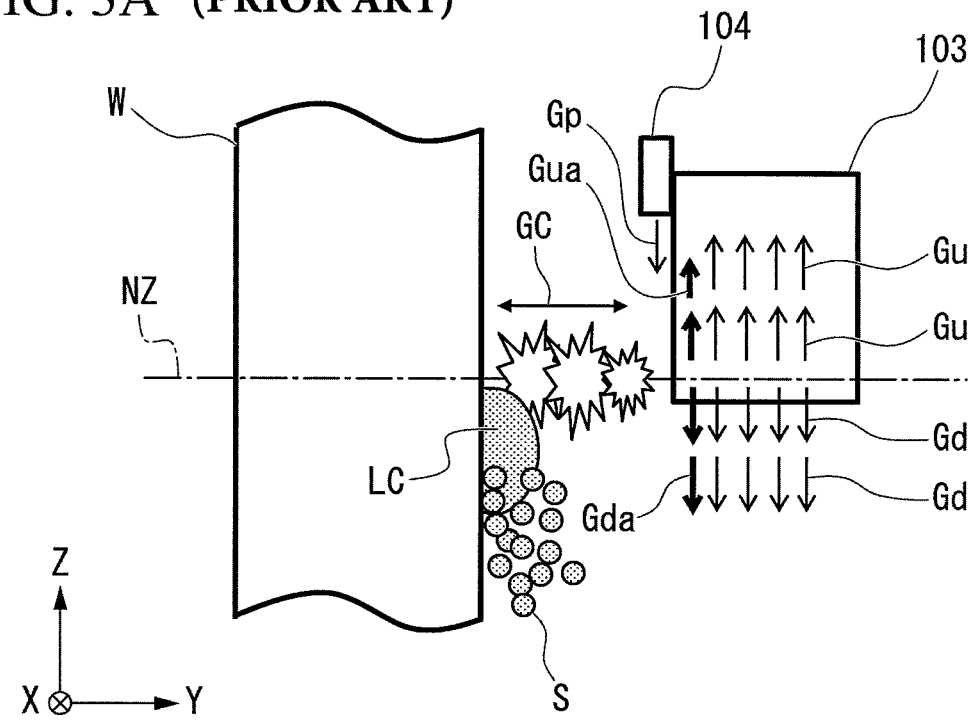
FIG. 3A (PRIOR ART)
FIG. 3A is a schematic view illustrating the splash suppression effect of a technique disclosed in Patent Document 1.
Figure 3B:
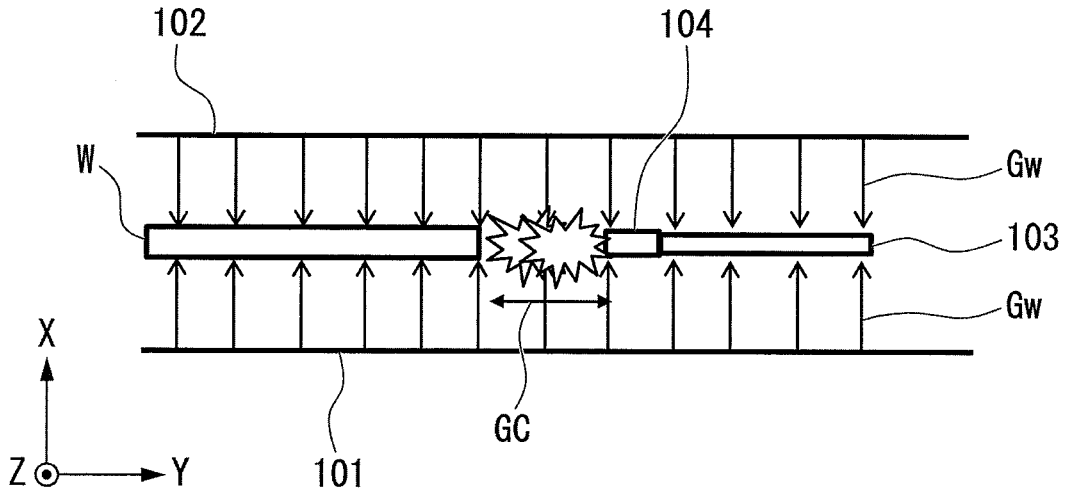
FIG. 3B (PRIOR ART)
FIG. 3B is a schematic view illustrating the splash suppression effect of the technique disclosed in Patent Document 1.

As illustrated in FIGS. 3A and 3B, in the technique disclosed in Patent Document 1, since the wiping gases Gw ejected from each of the wiping nozzles 101 and 102 collide with each other on both surfaces of the gas shield plate 103, an ascending flow Gu and a descending flow Gd of the wiping gas Gw are formed in a collision region (a position indicated by a reference symbol NZ in FIGS. 3A and 3B) as a starting point along each surface of the gas shield plate 103. Furthermore, an ascending associated flow Gua and a descending associated flow Gda occur in the vicinity of each end of the gas shield plate 103 in conjunction with the ascending flow Gu and the descending flow Gd of the wiping gas Gw.

The descending flow of the purge gas Gp is greatly dampened due to the ascending associated flow Gua occurring in the vicinity of each end of the gas shield plate 103. As a result, part of the gas turbulence occurring in the gas collision region GC does not stabilize as a downward gas flow, and the width in the Y direction of the gas collision region GC does not become small.

Since the ascending flow Gu of the wiping gas Gw, which is formed on each surface of the gas shield plate 103, is pressurized as highly as the wiping gas Gw is pressurized in conjunction with a high-speed hot dip coating process, the descending flow of the purge gas Gp is also greatly dampened. That is, the splash suppression effect caused by the purge gas Gp ejected from the purge gas ejection nozzle 104 is reduced in conjunction with the high-speed hot dip coating process.

Accordingly, when the embodiment is compared to the technique disclosed in Patent Document 1, the embodiment can provide the splash suppression effect greater than that of the technique disclosed in Patent Document 1.

The embodiment illustrates the configuration in which two first side nozzles 15 and 16 are directly disposed on both surfaces of the gas shield plate 13, and two second side nozzles 17 and 18 are directly disposed on both surfaces of the gas shield plate 14.

However, the present invention is not limited to the embodiment. As long as the descending side gas flows can be formed on both surfaces of the gas shield plates 13 and 14, there is no limit to the number or disposition of side nozzles.

Figure 4:
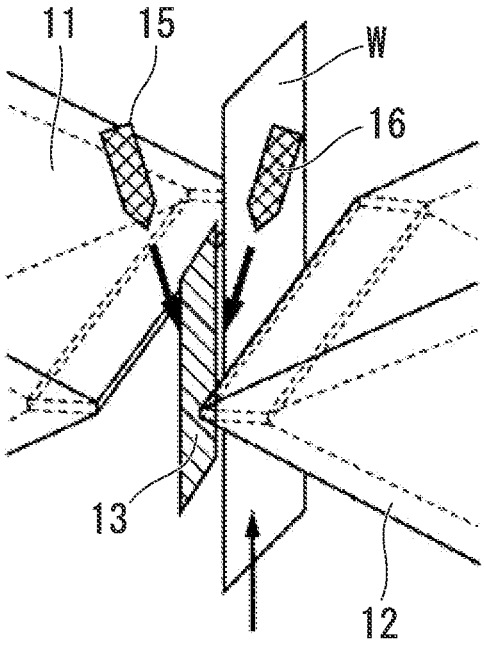
FIG. 4 is a schematic view illustrating a modification example of the embodiment.

For example, as illustrated in FIG. 4, the present invention may adopt a configuration in which the first side nozzles 15 and 16 are disposed at positions which separate upward from the gas shield plate 13, and eject the side gases toward both surfaces of the gas shield plate 13 from the positions. FIG. 4 does not illustrate positional relationships of the second side nozzles 17 and 18 with respect to the gas shield plate 14, but the positional relationships are also the same.

Figure 5A:
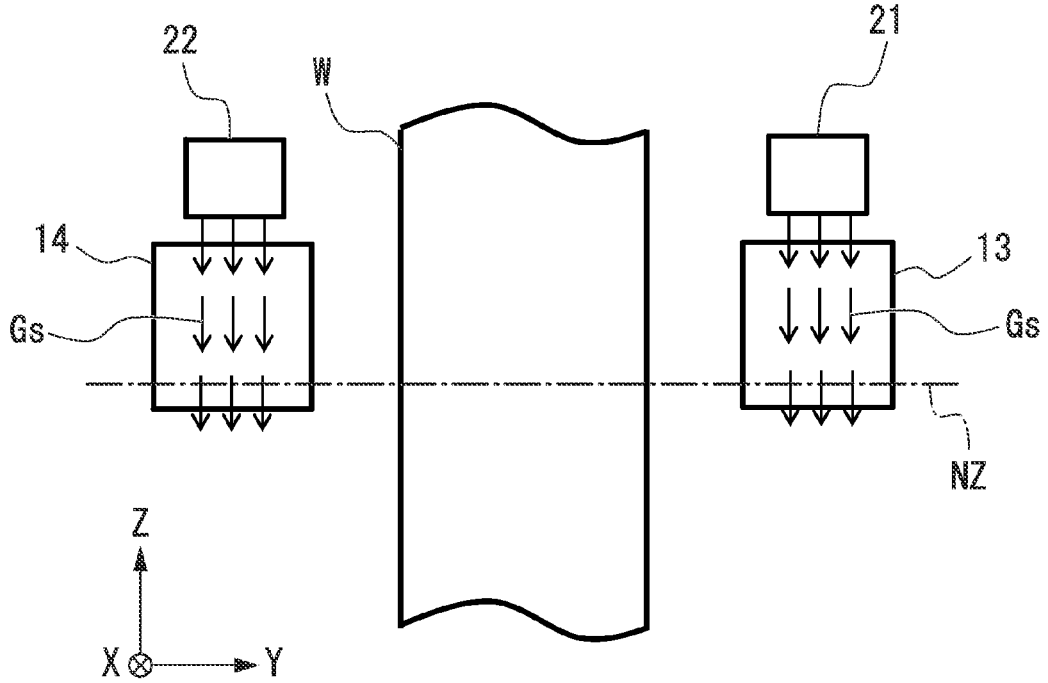
FIG. 5A is a schematic view illustrating a modification example of the embodiment.
Figure 5B:
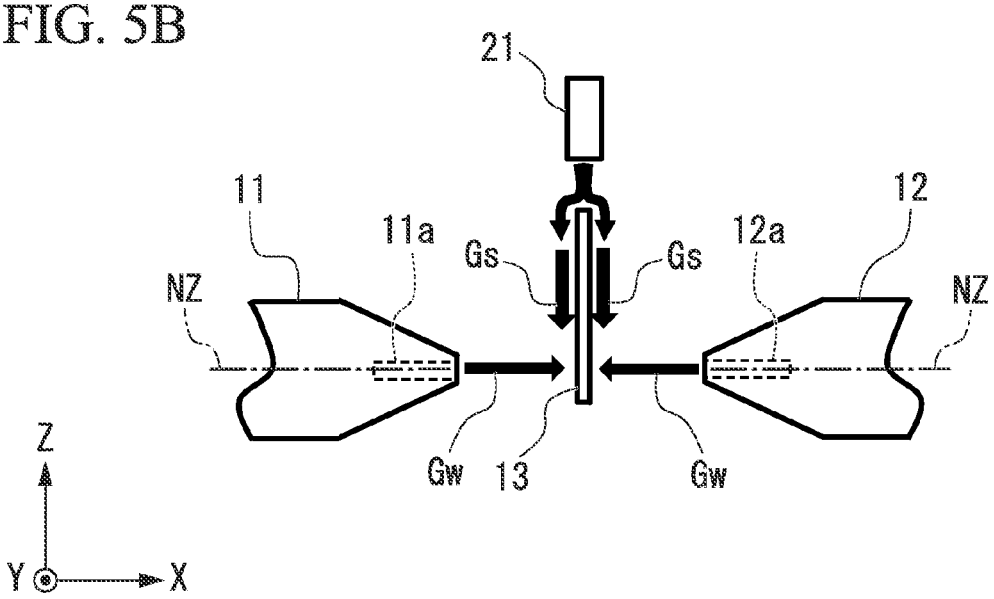
FIG. 5B is a schematic view illustrating the modification example of the embodiment.

For example, as illustrated in FIGS. 5A and 5B, the present invention may adopt a configuration in which in replacement of the first side nozzles 15 and 16, one first side nozzle 21 is provided directly above the gas shield plate 13, and in replacement of the second side nozzles 17 and 18, one second side nozzle 22 is provided directly above the gas shield plate 14.

As illustrated in FIG. 5B, a side gas Gs ejected vertically downward from the second side nozzle 21 is split into two descending flows centering around the gas shield plate 13. As a result, descending side gas flows are formed on both surfaces of the gas shield plate 13. A relationship between the second side nozzle 22 and the gas shield plate 14 will be also the same.

Figure 6A:
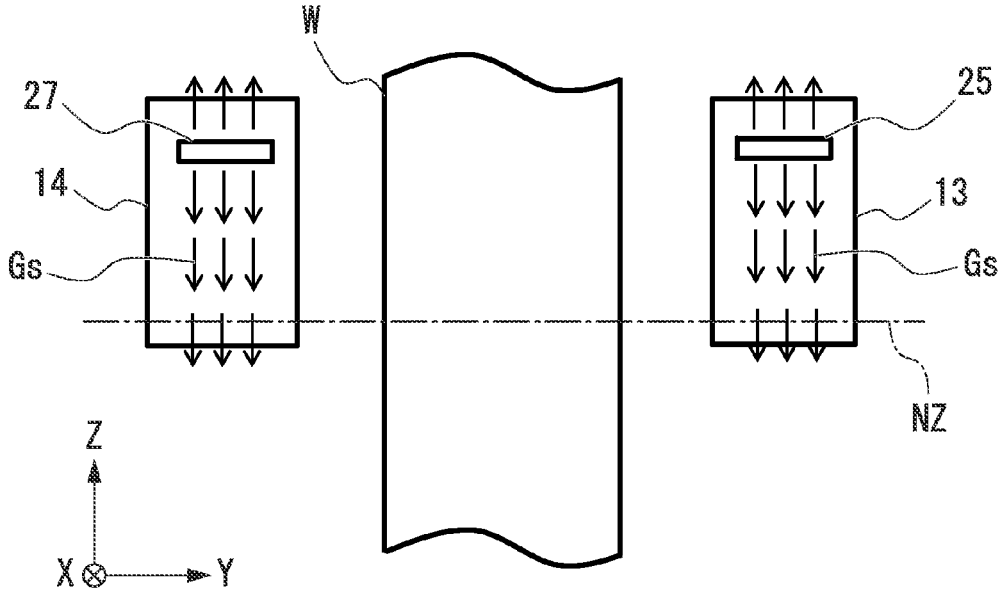
FIG. 6A is a schematic view illustrating a modification example of the embodiment.
Figure 6B:
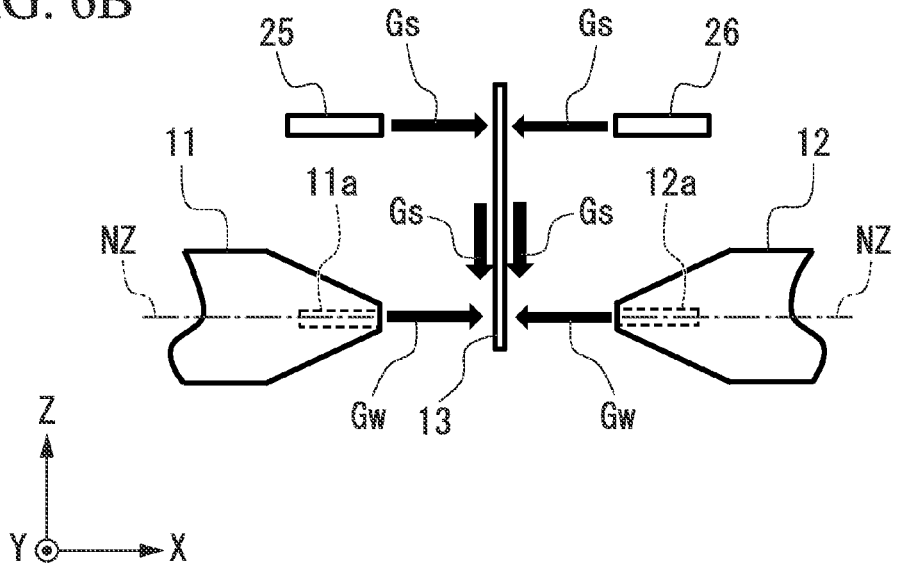
FIG. 6B is a schematic view illustrating the modification example of the embodiment.
Figure 7A:
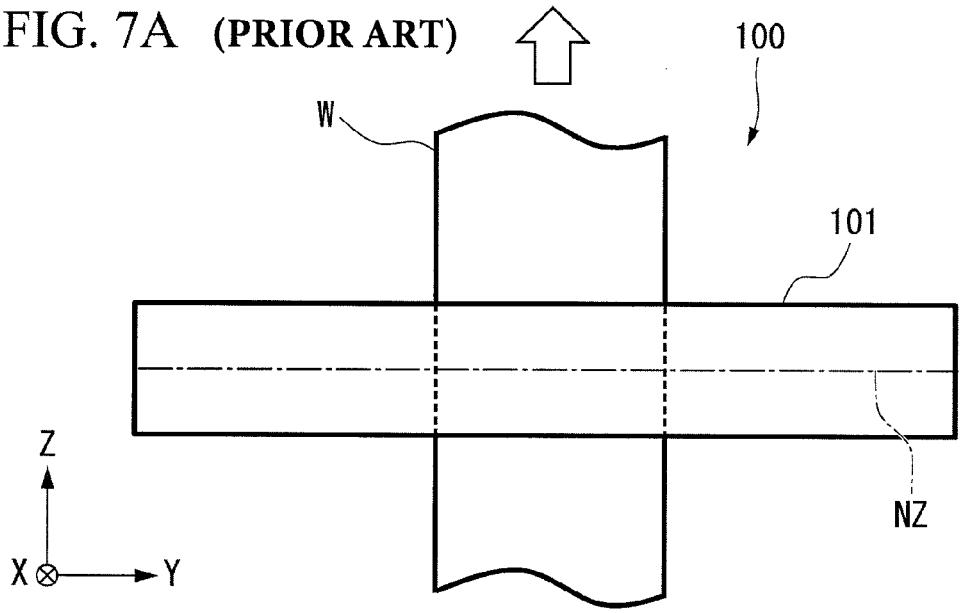
FIG. 7A (PRIOR ART)
FIG. 7A is a front view of a gas wiping apparatus 100 of the related art.
Figure 7B:
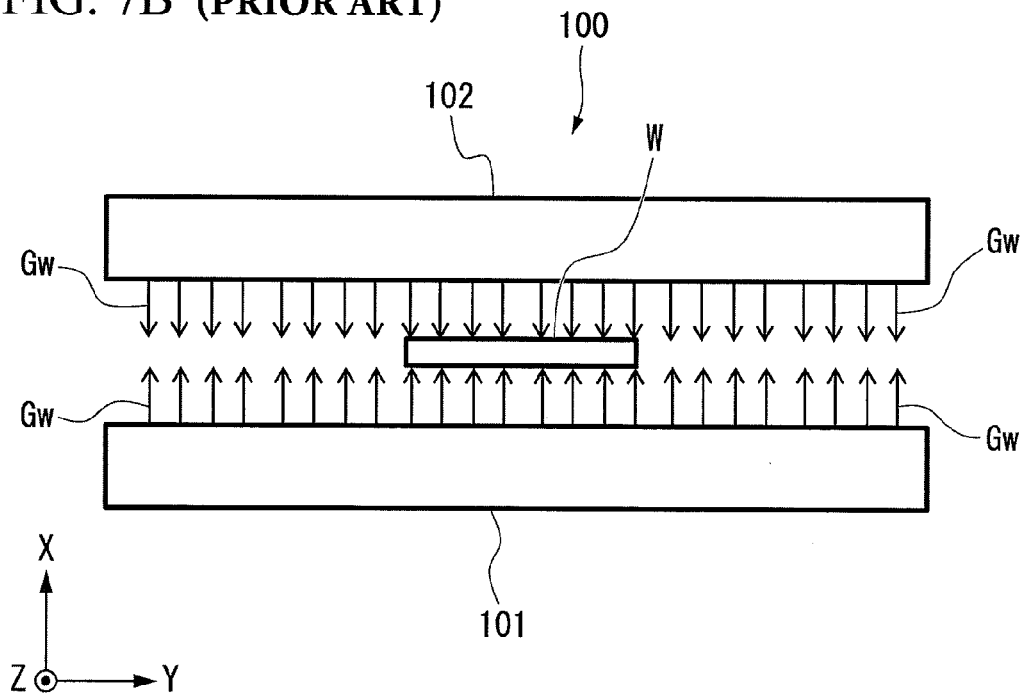
FIG. 7B (PRIOR ART)
FIG. 7B is a plan view of the gas wiping apparatus 100 of the related art.
Figure 7C:
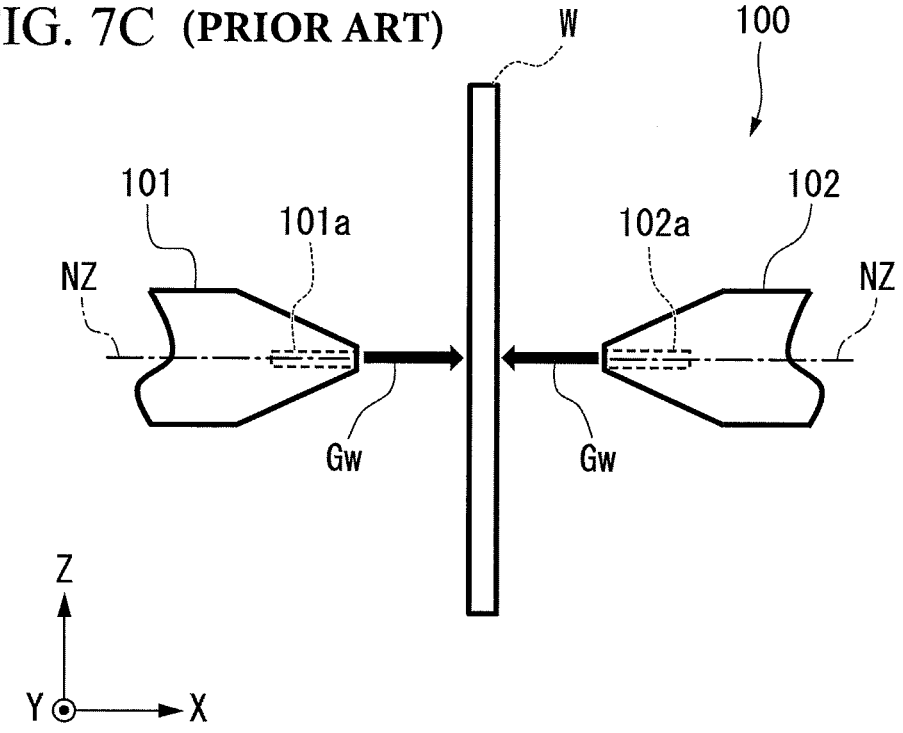
FIG. 7C (PRIOR ART)
FIG. 7C is a side view of the gas wiping apparatus 100 of the related art.
Figure 8A:
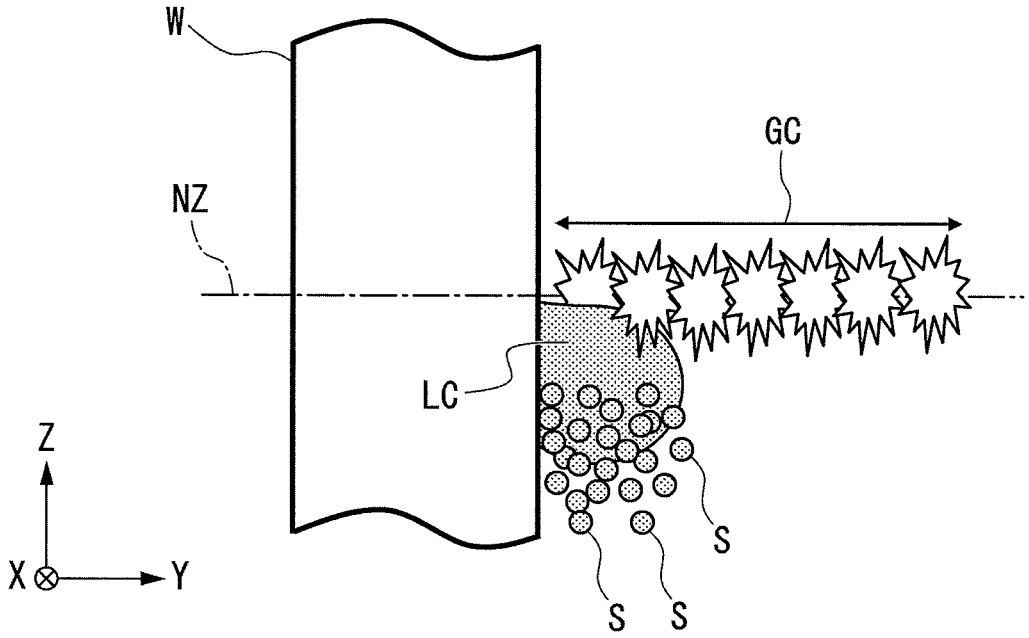
FIG. 8A (PRIOR ART)
FIG. 8A is a schematic view illustrating a mode in which splashes S spatter from each end portion of a coated steel sheet W due to gas turbulence occurring in a collision region GC of a wiping gas Gw.
Figure 8B:
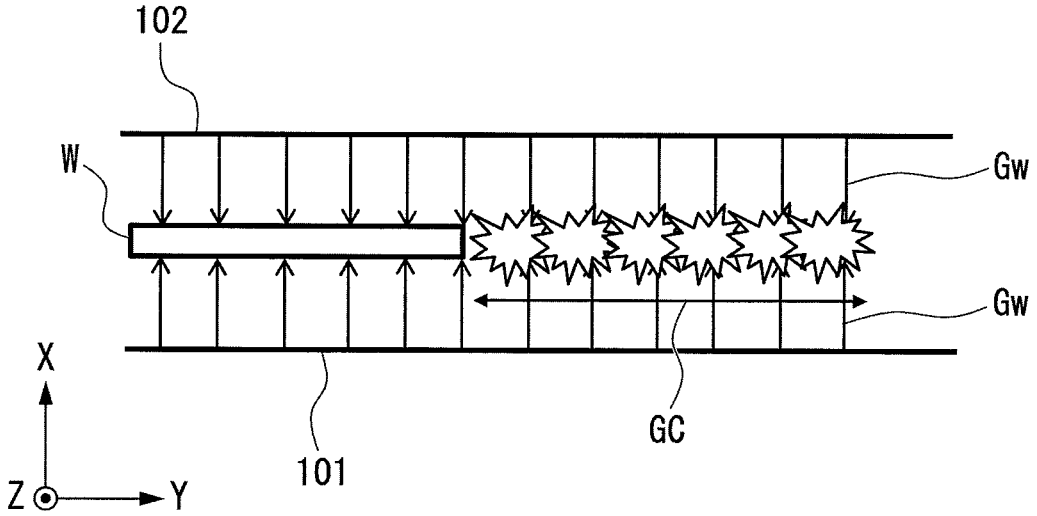
FIG. 8B (PRIOR ART)
FIG. 8B is a schematic view illustrating the mode in which the splashes S spatter from each end portion of the coated steel sheet W due to the gas turbulence occurring in the collision region GC of the wiping gas Gw.
Figure 9:
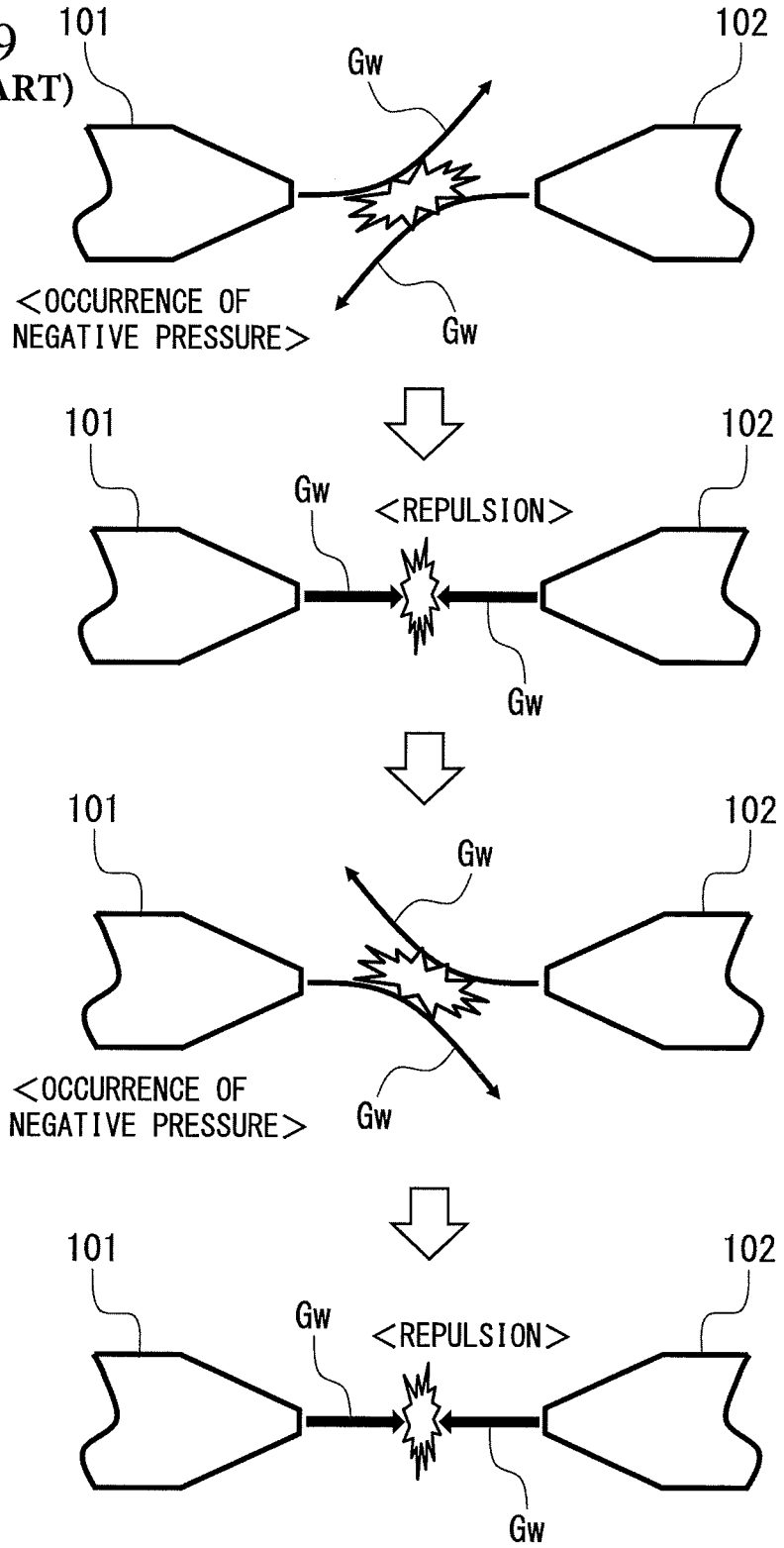
FIG. 9 (PRIOR ART)
FIG. 9 is a schematic view illustrating a mechanism in which gas turbulence (a gas flow, of which a pressure pulsates between a positive pressure and a negative pressure) occurs in the collision region GC of the wiping gas Gw to accompany occurrence of a negative pressure.

Furthermore, for example, as illustrated in FIGS. 6A and 6B, in replacement of the first side nozzles 15 and 16, a pair of first auxiliary nozzles 25 and 26 may be disposed downstream of the steel sheet W farther than the wiping nozzles 11 and 12 so that the pair of first auxiliary nozzles 25 and 26 face each other to interpose the gas shield plate 13 therebetween. In replacement of the second side nozzles 17 and 18, a pair of second auxiliary nozzles 27 and 28 may be disposed downstream of the steel sheet W farther than the wiping nozzles 11 and 12 so that the pair of second auxiliary nozzles 27 and 28 face each other to interpose the gas shield plate 14 therebetween. In FIGS. 6A and 6B, the second auxiliary nozzle 28 is not illustrated.

Each of the first auxiliary nozzles 25 and 26 ejects the side gas Gs toward the steel sheet W in the X direction. Accordingly, as illustrated in FIG. 6B, a descending flow (a descending side gas flow) of the side gas Gs is formed on each surface of the gas shield plate 13. Similarly, each of the second auxiliary nozzles 27 and 28 ejects the side gas Gs toward the steel sheet W in the X direction. Accordingly, a descending flow (a descending side gas flow) of the side gas Gs is formed on each surface of the gas shield plate 14 (not illustrated in FIG. 6B).

INDUSTRIAL APPLICABILITY

As described above, according to the present invention, it is possible to significantly suppress the spattering of the splashes in the hot dip coating process. Accordingly, the present invention is highly applicable to a coating industry.

BRIEF DESCRIPTION OF THE REFERENCE SYMBOLS

1, 100: GAS WIPING APPARATUS
11, 12, 101, 102: WIPING NOZZLE
13, 14, 103: GAS SHIELD PLATE
15, 16, 21: FIRST SIDE NOZZLE
17, 18, 22: SECOND SIDE NOZZLE
25, 26: FIRST AUXILIARY NOZZLE
27, 28: SECOND AUXILIARY NOZZLE
104: PURGE GAS EJECTION NOZZLE
W: COATED STEEL SHEET
Gw: WIPING GAS
Gs: SIDE GAS
Gp: PURGE GAS
GC: GAS COLLISION REGION
LC: LIQUID MEMBRANE OF HOT DIP COATING METAL
S: DROPLET OF HOT DIP COATING METAL (SPLASH)

The invention claimed is:

1. A gas wiping method in which a wiping gas is ejected along a width direction of a coated steel sheet from a pair of wiping nozzles which are disposed so as to face each other and interpose the coated steel sheet therebetween in a thickness direction of the coated steel sheet that is pulled upward from a coating bath and thus, the amount of a coating deposit of the coated steel sheet is adjusted, the method comprising:

disposing a first gas shield plate at a position which separates toward an outside from one end portion in the width direction of the coated steel sheet so that the first gas shield plate does not contact to one end portion of the coated steel sheet, and so that the first gas shield plate is interposed between the pair of wiping nozzles;

disposing a second gas shield plate at a position which separates toward an outside from the other end portion in the width direction of the coated steel sheet so that the second gas shield plate does not contact to the other end portion of the coated steel sheet, and so that the second gas shield plate is interposed between the pair of wiping nozzles;

disposing one of two first side nozzles, in a vicinity of an upper end of a front surface of the first gas shield plate, so as to contact with the front surface of the first gas shield plate and so as to be parallel to width direction of the coated steel sheet along the upper end of the front surface of the first gas shield plate;

disposing the other of the first side nozzles, in a vicinity of an upper end of a rear surface of the first gas shield plate, so as to contact with the rear surface of the first gas shield plate and so as to be parallel to width direction of the coated steel sheet along the upper end of the rear surface of the first gas shield plate;

disposing one of two second side nozzles, in a vicinity of an upper end of a front surface of the second gas shield plate, so as to contact with the front surface of the second gas shield plate and so as to be parallel to width direction of the coated steel sheet along the upper end of the front surface of the second gas shield plate;

disposing the other of the second side nozzles, in a vicinity of an upper end of a rear surface of the second gas shield plate, so as to contact with the rear surface of the second gas shield plate and so as to be parallel to width direction of the coated steel sheet along the upper end of the rear surface of the second gas shield plate;

ejecting a first side gas from each of the first side nozzles in a first direction reverse to a second direction in which the coated steel sheet is pulled upward and thus, forming a first gas flow along each of the front surface and the rear surface of the first gas shield plate in the first direction;

forming a first associated gas flow which flows between the first gas shield plate and one end portion of the coated steel sheet due to the first gas flow along each of the front surface and the rear surface of the first gas shield plate, the first associated gas flow flowing in the first direction;

ejecting a second side gas from each of the second side nozzles in the first direction and thus, forming a second gas flow along each of the front surface and the rear surface of the second gas shield plate in the first direction; and forming a second associated gas flow which flows between the second gas shield plate and the other end portion of the coated steel sheet due to the second gas flow along each of the front surface and the rear surface of the second gas shield plate, the second associated gas flow flowing in the first direction.

2. The gas wiping method according to claim 1, wherein the gas ejected from the side nozzle is air or an inert gas.

3. A gas wiping apparatus comprising:

a pair of wiping nozzles which are disposed so as to face each other and interpose a coated steel sheet therebetween in a thickness direction of the coated steel sheet that is pulled upward from a coating bath, and each of which ejects a wiping gas along a width direction of the coated steel sheet;

a first gas shield plate that is disposed at a position which separates toward an outside from one end portion of the coated steel sheet in the width direction of the coated steel sheet so that the first gas shield plate does not contact to one end portion of the coated steel sheet, and so that the first gas shield plate is interposed between the pair of wiping nozzles;

a second gas shield plate that is disposed at a position which separates toward an outside from the other end portion of the coated steel sheet in the width direction of the coated steel sheet so that the second gas shield plate does not contact to the other end portion of the coated steel sheet, and so that the second gas shield plate is interposed between the pair of wiping nozzles;

two first side nozzles, one of the first side nozzles, being disposed in a vicinity of an upper end of a front surface of the first gas shield plate, so as to contact with the front surface of the first gas shield plate and so as to be parallel to width direction of the coated steel sheet along the upper end of the front surface of the first gas shield plate, the other of the first side nozzles, being disposed in a vicinity of an upper end of a rear surface of the first gas shield plate, so as to contact with the rear surface of the first gas shield plate and so as to be parallel to width direction of the coated steel sheet along the upper end of the rear surface of the first gas shield plate;

two second side nozzles, one of the second side nozzles, being disposed in a vicinity of an upper end of a front surface of the second gas shield plate, so as to contact with the front surface of the second gas shield plate and so as to be parallel to width direction of the coated steel sheet along the upper end of the front surface of the second gas shield plate, the other of the second side nozzles, being disposed in a vicinity of an upper end of a rear surface of the second gas shield plate, so as to contact with the rear surface of the second gas shield plate and so as to be parallel to width direction of the coated steel sheet along the upper end of the rear surface of the second gas shield plate, wherein each of the first side nozzles ejects a first side gas in a first direction reverse to a second direction in which the coated steel sheet is pulled upward and thus, forms a first gas flow along each of the front surface and the rear surface of the first gas shield plate in the first direction, a first associated gas flow which flows between the first gas shield plate and one end portion of the coated steel sheet is formed due to the first gas flow along each of the front surface and the rear surface of the first gas shield plate, the first associated gas flow flowing in the first direction, each of the second side nozzles ejects a second side gas in the first direction and thus, forms a second gas flow along each of the front surface and the rear surface of the second gas shield plate in the first direction, and a second associated gas flow which flows between the second gas shield plate and the other end portion of the coated steel sheet is formed due to the second gas flow along each of the front surface and the rear surface of the second gas shield plate, the second associated gas flow flowing in the first direction.

4. The gas wiping apparatus according to claim 3, wherein a gas ejected from the side nozzle is air or an inert gas.

* * * * *